US006158377A

United States Patent [19]

Szukhent, Jr.

[11] Patent Number: 6,158,377

[45] Date of Patent: Dec. 12, 2000

[54] KNOCK-DOWN CANOPY

[76] Inventor: Steve Szukhent, Jr., 3475 Williamson Rd., Saginaw, Mich. 48601

[21] Appl. No.: 09/369,290

[22] Filed: Aug. 6, 1999

[51] Int. Cl.[7] ..... B63B 17/00

[52] U.S. Cl. ..... 114/361

[58] Field of Search ..... 114/361, 343

[56] References Cited

U.S. PATENT DOCUMENTS

| | | | |
|---|---|---|---|
| D. 237,103 | 10/1975 | Fisher | D54/1 R |
| D. 270,186 | 8/1983 | Jones | D25/74 |
| D. 307,637 | 5/1990 | Kennedy et al. | D25/119 |
| 2,714,387 | 8/1955 | Meldrum | 114/361 |
| 3,165,111 | 1/1965 | Foster | 135/6 |
| 3,172,419 | 3/1965 | Lewis | 136/6 |
| 4,815,410 | 3/1989 | Muhlberger | 114/364 |
| 5,367,977 | 11/1994 | Ellis et al. | 114/361 |
| 5,452,678 | 9/1995 | Simpkins | 114/361 |
| 5,458,079 | 10/1995 | Matthews et al. | 114/361 |
| 5,698,288 | 12/1997 | Barnes | 428/76 |
| 5,706,752 | 1/1998 | Menne, Jr. et al. | 114/361 |
| 5,706,753 | 1/1998 | Menne et al. | 114/361 |

*Primary Examiner*—Stephen Avila
*Attorney, Agent, or Firm*—John J. Swartz

[57] ABSTRACT

A knock-down canopy shelter for a boat, such as a pontoon boat, including a cover sheet of fabric, such as canvas, for overlying the deck of a boat, and a knock-down canopy framework which can be disassembled for storage and shipping and assembled to support the covering over the deck. The framework includes a pair of elongate side rails which are mounted on laterally opposite sides of the boat and include laterally integrally lower upstanding elongate slotted portion for mounting port post projecting upwardly from the boat, and an upper elongate lift supporting portion including laterally inwardly, upwardly inclined elongate slots. The framework also includes a plurality of longitudinally spaced apart, laterally extending cross rails and the plurality of coupling members for detachably which include laterally inner transverse portions detachably coupled to opposite ends of the cross rails and laterally outer rails elongate portions detachably received in the slots for coupling the cross rails to the side rails. Mechanism is provided for detachably coupling the fabric covering to the framework.

54 Claims, 6 Drawing Sheets

KNOCK-DOWN CANOPY

BACKGROUND OF THE INVENTION

1. Field of the Invention

This invention relates to a canopy for covering an area to be protected and more particularly, to a knock-down canopy top for covering the deck of a boat, such as a pontoon or deck boat.

2. Description of the Prior Art and Objects

Pontoon boat canopy tops typically include an aluminum skin fixed to an aluminum frame, such as that disclosed in U.S. Pat. No. 5,452,678 issued to Sep. 26, 1995, to Terry J. Simpkins. Such fixed aluminum tops are either delivered as an original equipment unit assembled and mounted on a boat, or shipped as assembled as replacement unit. Because of their vast girth, such tops are costly to ship on a common carrier and are subject to damage in shipping. Accordingly, it is an object of the present invention to provide a knock-down canopy top which can be easily shipped and stored in a disassembled condition and assembled after shipping.

It is another object of the present invention to provide a new and novel knock-down canopy framework for detachably mounting a fabric covering which can be easily and quickly assembled and disassembled.

Various prior art framework has been provided heretofore for mounting a fabric covering on pontoon boats and typically includes a tubular aluminum framework which can be either fixed on the pontoon boat thereon for convertible movement and/or pivoted between an extended position or a folded non-covering position.

Prior art fastening systems for detachably coupling a cover to an aluminum tabular framework has typically included a male fastener secured to the boat framework and a corresponding female snap fastener secured to the fabric cover. Other fasteners, such as that disclosed in U.S. Pat. No. 5,706,753 issued to Timothy J. Menne, et al, on Jan. 13, 1998, and U.S. Pat. No. 5,706,752 issued to Robert J. Menne, Jr., et al, on Jan. 13, 1998, have also been provided. These prior art constructions, however, include a framework which may not readily disassembled for shipping and storage. Accordingly, a further object of the present invention is to provide a new and novel canopy framework which can be more easily disassembled, stored and shipped relative to the prior art canopy top frameworks.

The storage of assembled replacement canopy units for even a small portion of the many different size and type pontoon boats is cost probative for many boat dealers. Accordingly, it is an object of the present invention to provide a knock-down canopy kit which can be adapted to a large variety of pontoon boats.

It is another object of the present invention to provide a knockdown canopy kit which includes side rails and cross bows which can be stored in disassembled condition and then cut to the length required at the time of assembly.

It is a further object of the present invention to provide a method of assembling a canopy top kit on any selected one of a plurality of different length and width pontoon boats including the steps of cutting a plurality of cross bows and side rails to any selected length, and drilling holes in the ends of the cross bows and a plurality of holes at any selected locations in the side rails prior to assembly.

It is a further object of the present invention to provide a new and novel knock-down canopy top of the type described including a pair of elongate side rails, a plurality of longitudinally spaced apart laterally extending cross rails and new and novel coupling members for detachably coupling the cross rails to the side rails.

It is yet another object of the present invention to provide a new and novel knock-down canopy top of the type described including a new and novel coupling member which includes a laterally inner transversely extending portion for detachably coupling to an end of a cross beam and a laterally outer, longitudinally extending portion for detachably coupling to one of a pair of side rails.

Still another object of the present invention is to provide a new and novel canopy top shelter of the type described including a new and novel L-shaped coupling members having a laterally inner transversely extending leg for telescopically receiving an outer end of a cross rail and a laterally outer longitudinally extending end for mounting on a side rail.

It is a further object of the present invention to provide a new and novel knock-down canopy top framework which will ease the replacement oft a damaged section of a canopy top.

Still yet another object of the present invention is to provide a new and novel frame for detachably mounting a soft top on a pontoon boat.

U.S. Pat. No. 5,472,678 discloses curved frame bows which have ends received in complementally formed upwardly inwardly inclined slots provided in side rails of relatively complex and expensive construction. Accordingly, it is another object of the present invention is to provide a new and novel side rail for a knock-down canopy top.

Yet another object of the present invention is to provide a new and novel knock-down canopy top side rail including an elongate, upwardly inwardly inclined slot for detachably mounting a plurality of cross rails.

Still another object of the present invention is to provide a new and novel knock-down canopy top side rail which includes an elongate lower portion for mounting on a plurality of upstanding posts and an upper, laterally outwardly offset portion for detachably mounting the cross rails.

Still another object of the present invention is to provide a new and novel knock-down canopy top side rail which includes an elongate lower portion having laterally inner and outer upstanding lower walls defining a downwardly opening, elongate slot for receiving a plurality of upstanding mounting posts, and a laterally outer upper wall which is integral with the laterally outer lower wall but upwardly outwardly inclined relative thereto, and a pair of laterally inwardly upwardly projecting flanges mounted on the laterally outer upper wall defining on an upwardly inward inclined slot for detachably receiving one end of a cross rail.

Yet another object of the present invention is to provide a knock-down canopy top framework of the type described including side rails having a lower portion for mounting on upstanding posts and an upper portion having a pair of upwardly inwardly inclined flanges defining an elongate slot for receiving coupling members detachably coupled to a plurality of cross rails.

It is another object of the present invention is to provide a knock-down canopy top kit which includes a pair of side rails with an outboard wall having upper and lower vertically spaced walls defining an upwardly inwardly opening elongate channel and brackets for detachably coupling the ends of the cross rail to the channel.

It is another object of the present invention is to provide a new and novel method of assembling and disassembling a knock-down canopy top framework.

It is important that the canopy frame be durable, long lasting and thus it is important that the junction of the assembled cross-rails and side rails is such as to eliminate relative movement therebetween. If such movement is allowed to creep into the junction, the parts will "wobble out" and the frame will deteriorate. The prior art canopy frame construction illustrated in U.S. Pat. No. 5,452,678, the ends of the cross bows, which have little breadth, are directly received within the side rail slots and thus, there is relatively small mating bearing surfaces at the junctions thereof to inhibit relative movement. Accordingly, it is an object of the present invention to provide a knock-down canopy top of the type described which, when assembled, will be rigid.

It is another object of the present invention to provide a new and novel knock-down canopy top coupling member which joins the ends of the cross rails to the side rails.

It is yet another object of the present invention to provide a knock-down canopy of the type described including a plurality of longitudinally spaced apart cross bows which have crowned laterally extending midportion and laterally outer, longitudinally extending end portions which are detachably received in confronting elongate slots provided in a pair of side rails that are detachably mounted on upright posts.

Yet another object of the present invention is to provide a new and novel coupling member for detachably coupling a plurality of cross rails to a pair of side rails and includes inner, laterally inwardly projecting portions which are mounted on the outer ends of a plurality of cross members and laterally outer elongate portions which are detachably received in the elongate slots provided in each of the side rails.

Another object of the present invention is to provide a new and novel coupling member for detachably coupling a plurality of cross rails to a pair of side rails of the type described including new and novel L-shaped brackets each having upper and lower mating halves sandwiching a spring mounted locating pin therebetween for movement between a position detachably locking an end of a cross frame member to the coupling member and a non-locking position.

It is a further object of the present invention to provide a new and novel L-shaped coupling bracket of the type described which includes complementally formed upper and lower L-shaped bracket halves which cooperate to provide a laterally inwardly projecting leg which is telescopically received within an outer end of a cross bow and which cooperate to detachably define an elongate internal recess for receiving a leaf spring mounting a locating button that can selectively project and recess within an opening provided in the lower L-shaped bracket half.

A further object of the present invention is to provide a L-shaped mounting bracket of the type described including a locking opening in lower L-shaped half, and a locating pin slidably mounted in the opening for movement between an outwardly projecting position received by a complementally formed opening in an end of a cross bow and a non-locking recess position flush with the underside of the lower L-shaped half.

It is yet another object of the present invention to provide a method of assembling an L-shaped coupling member of the type described on a pontoon boat canopy shelter including the steps of disposing a leaf spring between the laterally inner confronting legs of upper and lower L-shaped coupling halves and aligning a push button, which is integral with the leaf spring, with a first opening provided in a transverse portion of the lower coupling member for movement therein between a retracted position, generally flush with the underside of the laterally inner leg of the lower coupling member, and a locking position projecting outwardly beyond the underside of the lower coupling half, and then aligning the opening in the lower half with an opening provided in the cross rail to allow the push button to spring outwardly into the opening provided in the cross rail.

Other objects and advantages of the present invention will become apparent to those of ordinary skill in the art as the description thereof proceeds.

SUMMARY OF THE INVENTION

A knock-down canopy top framework for detachably mounting a flaccid cover on a boat of the like including a pair of laterally spaced apart side rails including confronting, upwardly inwardly inclined slots; a plurality of longitudinally spaced apart cross rails, including opposite ends, extending between the side rails; and a plurality of coupling brackets for detachably coupling the opposite ends of the cross rails to the side rails; each of the brackets including a laterally outer portion slidably detachably received by one of the slots and a laterally inner portion for telescopically detachably receiving one of the ends of one of the cross rails.

DESCRIPTION OF THE DRAWINGS

The invention may be more readily understood by referring to the accompanying drawings, in which.

DESCRIPTION OF PREFERRED EMBODIMENT

Figure 1:
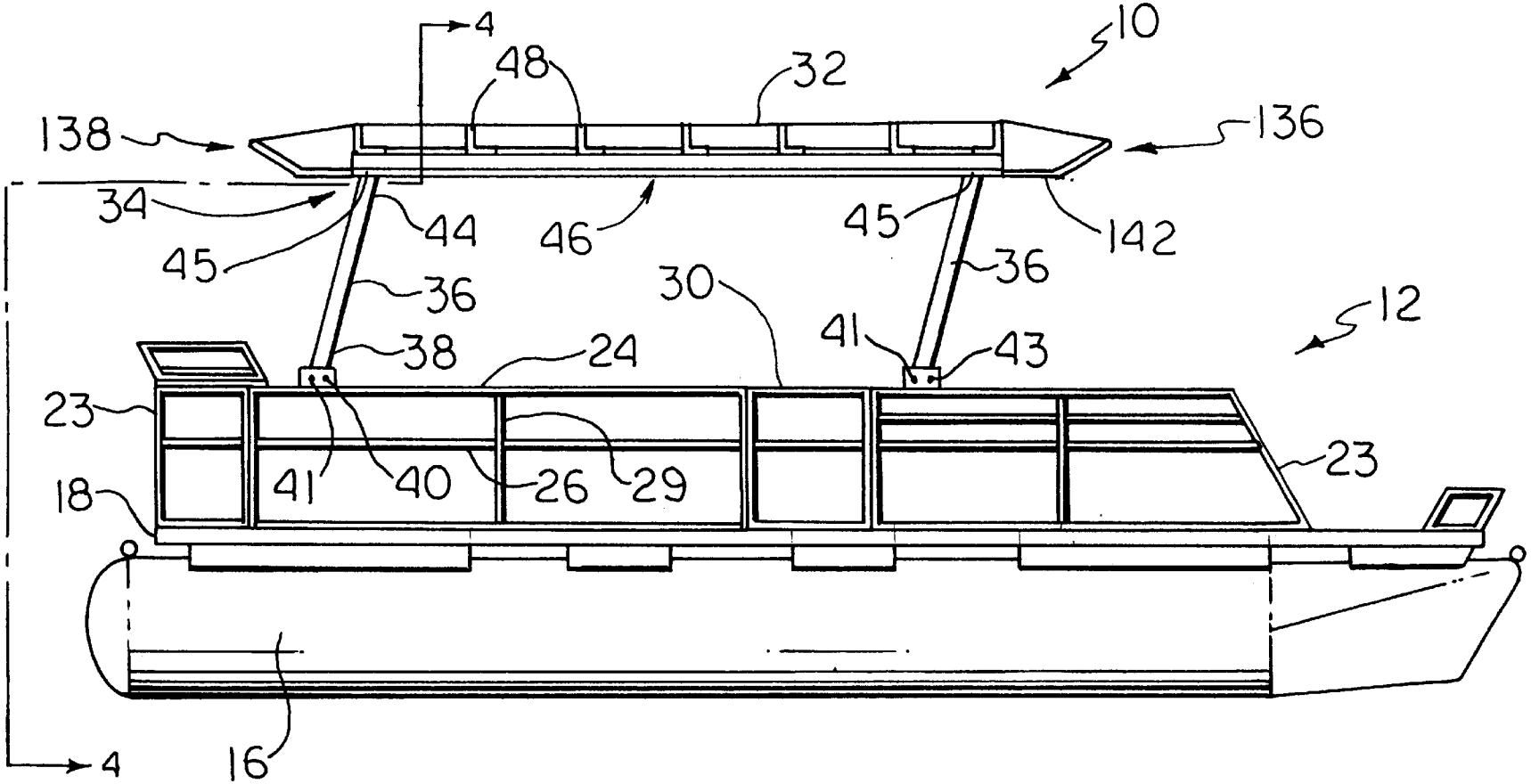
FIG. 1 is a side elevational view of a knock-down canopy constructed according to the present invention, mounted on a pontoon boat with the canopy cover being broken away to more particularly illustrate the underlying canopy top framework.
Figure 2:
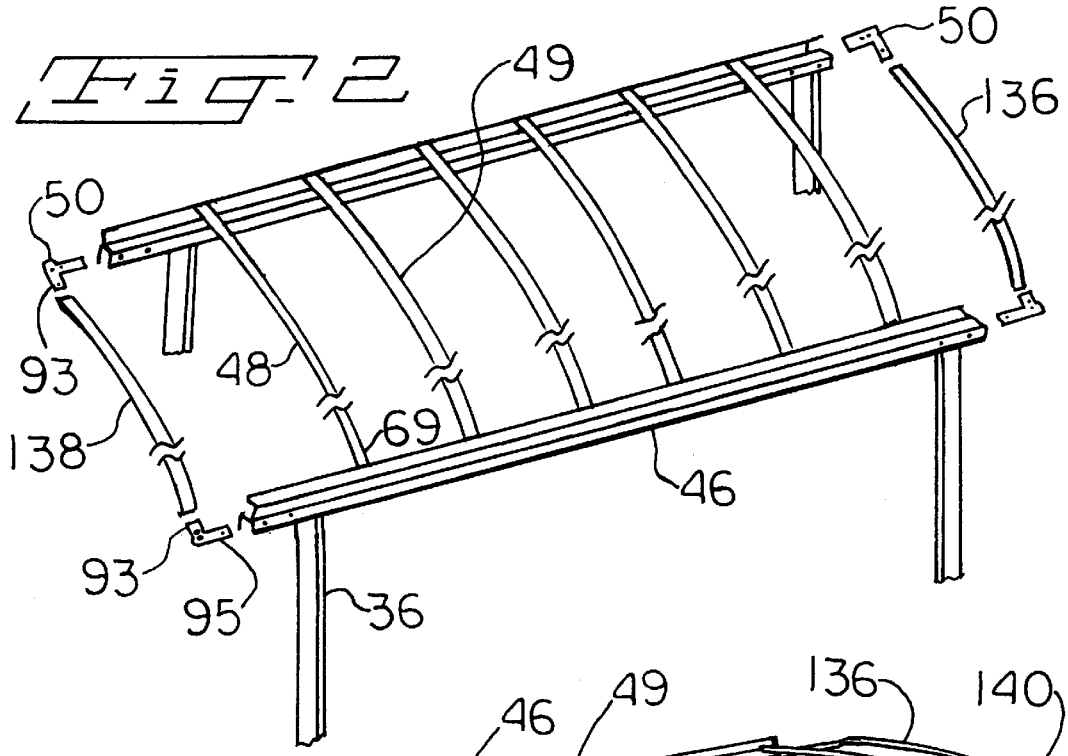
FIG. 2 is a perspective partially exploded fragmentary view of the canopy framework illustrated in FIG. 1 in a partial stage of assembly schematically illustrating L-shaped coupling members for coupling two of the cross rails to the side rails.

A knock-down canopy top, generally designated 10, constructed according to the present invention, is mounted on a pontoon boat, generally designated 12, having a pair of laterally spaced apart hollow aluminum flotation tubes 16 mounting a horizontally disposed deck 18 which may be suitably comprise a marine plywood construction. An upstanding fence, generally designated 20, is mounted about a portion of the perimeter of the deck 18. The fence 20 can suitably comprise a plurality of upstanding hollow aluminum tubular posts 22 including intermediate posts 29 and comer posts 23, mounted on each lateral side of the deck 18 and spanned by a top rail 24 and an intermediate rail 26. Front and rear end rails, generally designated 28, span the upstanding comer posts 23. A doorway 30 is hingedly coupled to one of the intermediate posts 29 to provide access to the deck 18.

The canopy top shelter 10 includes a canopy top cover, generally designated 32, draped on a knock-down canopy top frame, generally designated 34. The canopy top cover 32 may suitably comprise a sheet of canvas which is detachably draped over the frame 34, once assembled.

The frame 34 includes four upstanding corner posts 36 having lower ends 38 pivotally mounted on the top fence rail 24 via brackets 40 and pivot pins 41. Additional stop pins 43 are mounted in aligned openings in the brackets 40 and the lower post ends 48 to hold the posts 46 in an upstanding position as illustrated. Upon removal, the stop pins 43 allow the entire top to be downwardly swung to a lowered stowed position.

The frame 34 also includes a roof framework, generally designated 42, pivotally mounted on the upper ends 44 of the laterally and longitudinally spaced apart corner posts 44 via pivots 45. The roof framework 42 includes a pair of laterally spaced apart, longitudinally extending, elongate one-piece side rails, generally designated 46, and a plurality of laterally extending, longitudinally spaced apart cross rails or bows, generally designated 48, and coupling members, generally designated 50, for coupling the cross rails 48 to the side rails 46. The cross bows 48 may suitably comprise extruded hollow aluminum tubes, which are square in cross-section, and include central, upwardly bowed mid-portions 49 between opposite terminal ends 69.

The side rails 46 may each suitably comprise a one-piece elongate extruded aluminum member. Each rail includes a laterally outer, generally upstanding side wall, generally designated 52, having a lower vertical side wall portion 54 and a laterally outwardly upper side wall portion 56 which is laterally outwardly offset relative to the lower side wall portion 54.

The side rails 46 each includes a laterally inner, vertical, lower side wall portion or flange 58 coupled to the outer lower side wall portion 54 via a top wall 60 which, together with the lower wall portion 54, define a downwardly opening elongate slot 62 for receiving the comer posts 36 in any selected one of a plurality of longitudinally spaced apart positions within the slot 62. The side rails 46 may thus be adapted to be easily mounted on a plurality of different length boats which have upstanding coming posts spaced apart at various distances.

The upper vertically laterally outwardly inclined upper side wall portion 56 mounts upper and lower flanges 64 and 66 which along with the side wall portion 56, define a laterally inwardly upwardly inclined longitudinally extending slot 68. The slots 68 on laterally opposite sides of the boat 12 are thus upwardly inwardly converging and are inclined at the same angle of inclination as are the ends 69 of the cross rails 48 when installed thereon.

The laterally outer lower side wall portion 54 includes laterally outer, vertically spaced apart, oppositely turned integral ribs 70 which slidably mount complementally formed, generally U-shaped slides 72 that are coupled to the laterally outer terminal end 74 of the cover 32.

The laterally inner lower flange 58 mounts a pair of vertically spaced apart inwardly turned laterally inner, integral ribs 76 which define a pair of confronting slots 77 that receives a longitudinal strip of a hook and loop fastener 82 (such as VELCRO®) which can be utilized to mount a curtain 80 with a complementally formed hook and fastener. Welt cord channels 84 and 86 are integrally mounted at the lower ends of the laterally inner and outer lower wall portions 54 and 58, respectively, for attachment to welt cords 88 and 90, respectively, at the upper ends of privacy curtains or covers 92 and 94, respectively.

Figure 8:
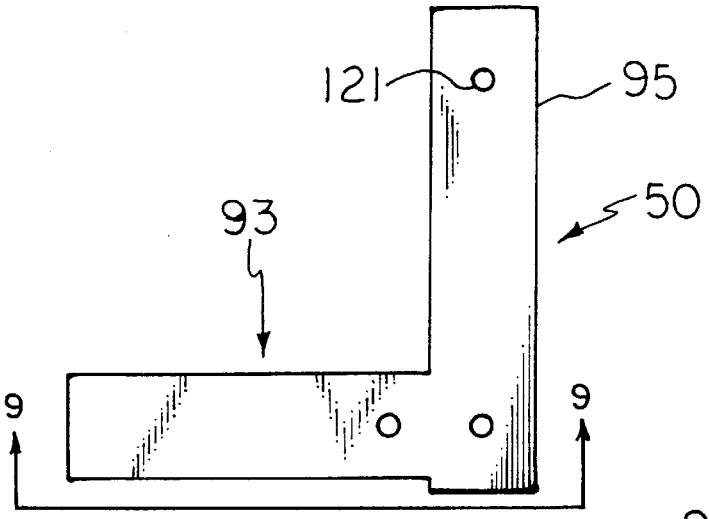
FIG. 8 is a greatly enlarged top plan view of an L-shaped coupling bracket taken along the section line 8—8 of FIG. 7.
Figure 9:
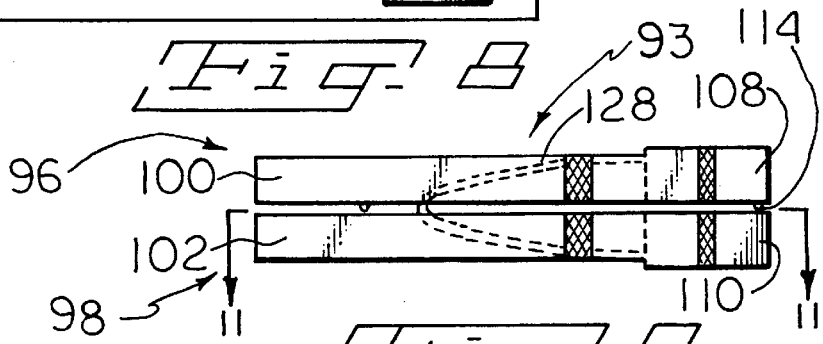
FIG. 9 is an end elevational view taken along the section line 9—9 of FIG. 8.
Figure 10:
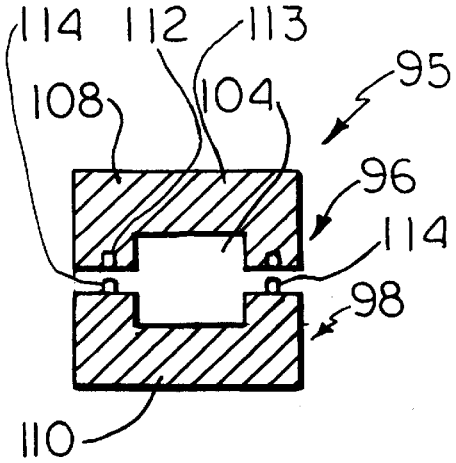
FIG. 10 is a greatly enlarged sectional side view, taken along the section line 10—10 of FIG. 9, more particularly illustrating the laterally inwardly extending leg of the L-shaped bracket for coupling to a cross frame.
Figure 11:
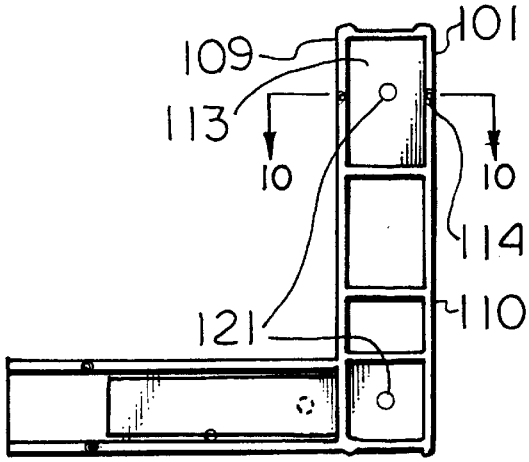
FIG. 11 is a sectional plan view, taken along the section line 11—11 of FIG. 9 and illustrating a L-shaped coupling member in a partially assembled condition with a locating spring being disposed on the upper inside surface of a laterally inwardly extending leg of the lower half of the coupling member.

The coupling member 50 is generally L-shaped as illustrated in FIGS. 8 and 11, and includes a laterally inwardly extending transverse leg 93 which is snugly, telescopically received in a laterally outer complementally formed square end 69 of a cross rail 48, and a laterally outer, longitudinally extending laterally outer leg 95. The coupling member 50 includes upper and lower complementally formed, mating L-shaped halves 96 and 98, respectively, which may comprise die cast aluminum.

Upper and lower L-shaped mating halves 96 and 98, which may suitably comprises injection molded plastic, are U-shaped in cross section and include laterally inwardly extending confronting, leg portions 100 and 102, respectively, and integral, complementally formed laterally outer upper and lower complementally formed U-shaped leg portions 108 and 110, respectively, which cooperate to form the laterally outer, longitudinally extending bracket leg 95.

The laterally outer upper leg portion 95 each includes laterally inner and outer vertical walls or flanges 109 and 111 depending from a horizontal base 113. Locating apertures 112 are mounted on the underside end walls 109 and 111 of upper L-shaped half 96 for mating with complementally formed integral locating pins 114 in the lower L-shaped half 98, to ensure that the upper and lower halves 96 and 98 can be quickly and accurately positioned when being coupled together.

Figure 7:
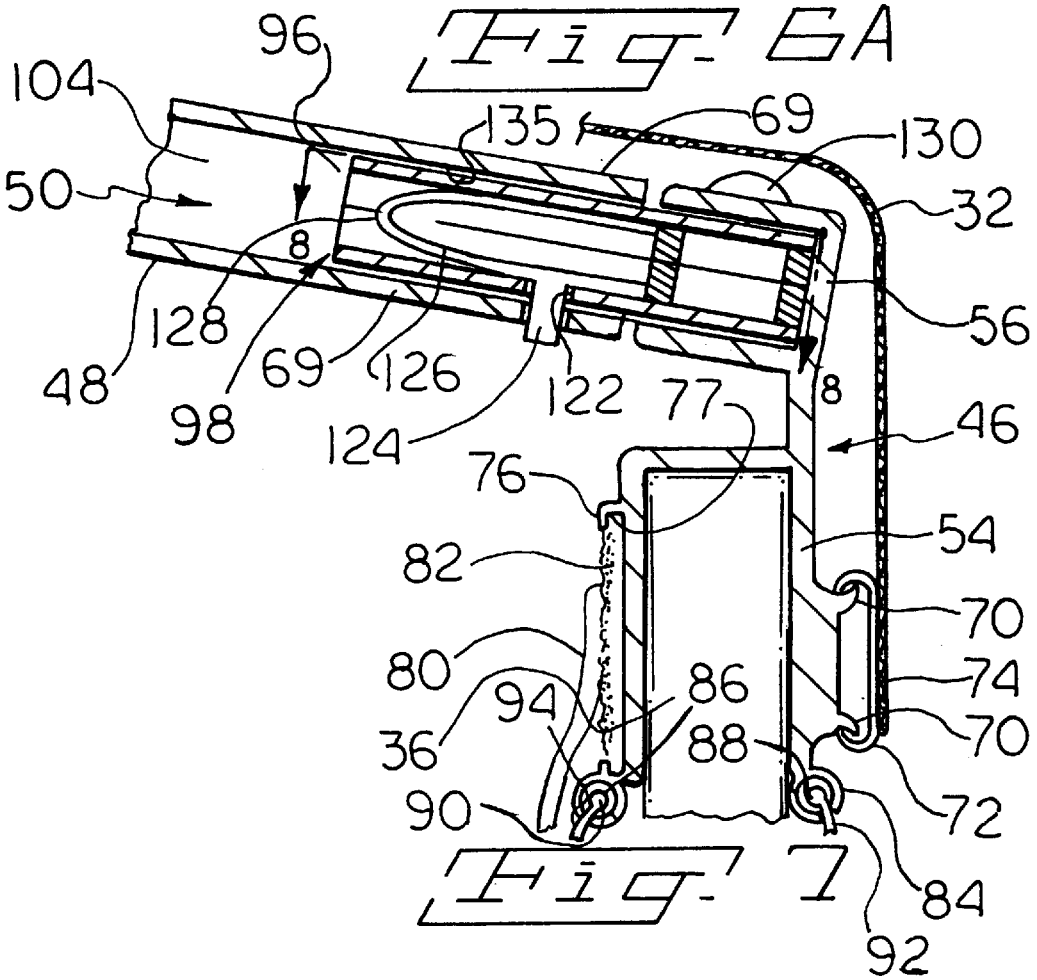
FIG. 7 is a greatly enlarged sectional end view, taken along the section line 7—7 of FIG. 3A more particularly illustrating one of the L-shaped coupling members coupling an end of a cross rail to a side rail.

A vertical locking pin receiving opening or passage 122 is provided in the lower half, laterally inwardly extending leg 102 for receiving a vertical locating pin or push button 124 slidingly received in a complementally formed aperture 126 provided in the lower sidewall of each terminal end 69 of each cross rail 48. When the locking apertures 122 and 126 are aligned, as illustrated in FIG. 7, the locking pin 124 will pass through the opening 126 to detachably lock the L-shaped member 50 to the ends of the cross rails 48.

The locating pin is integrally attached to the lower leave 126 of a generally V-shaped leaf spring 128 which also includes an integral upper leave 129. The leaf spring 128 will urge the locating pin 124 downwardly but will yield to allow the locating pin 124 to move vertically upwardly so as to clear the opening 124 and allow the bracket 50 to be laterally outwardly moved relative to the cross rail 48.

The side rails 46 are detachably coupled to the laterally outer bracket legs 95 via a pair of bolts 130 which pass through aligned openings 121 in the upper and lower leg portions 108 and 110 and aligned openings in the upper and lower side rail flanges 64 and 66 for detachably coupling the legs 95 to the upper bracket portion 66.

Figure 12:
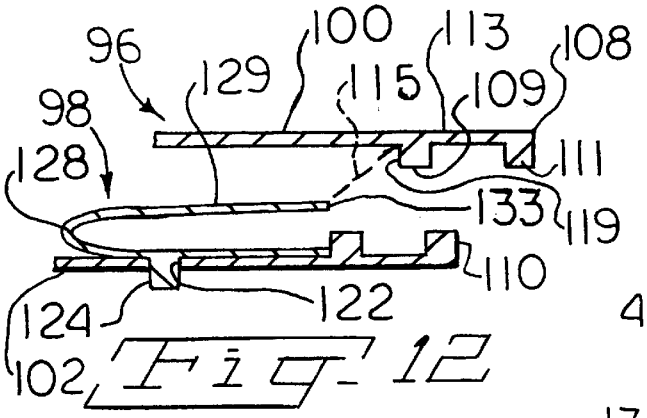
FIG. 12 is a sectional view illustrating another interim step of assembly of the L-shaped mounting brackets.

During installation, the locking pin 124 is initially disposed in the lower aperture 122, of the lower half 98 in the position illustrated in FIG. 12, and the upper L-shaped half 96 is moved laterally inwardly and downwardly along a dotted line 115 so that the laterally inner surface 117 of the longitudinally extending leg half 108 bears against the outer terminal end 133 of the upper leaf spring leaf 129. The halves 96 and 98 are moved together to partially compress the leaf spring 128.

Figure 4:
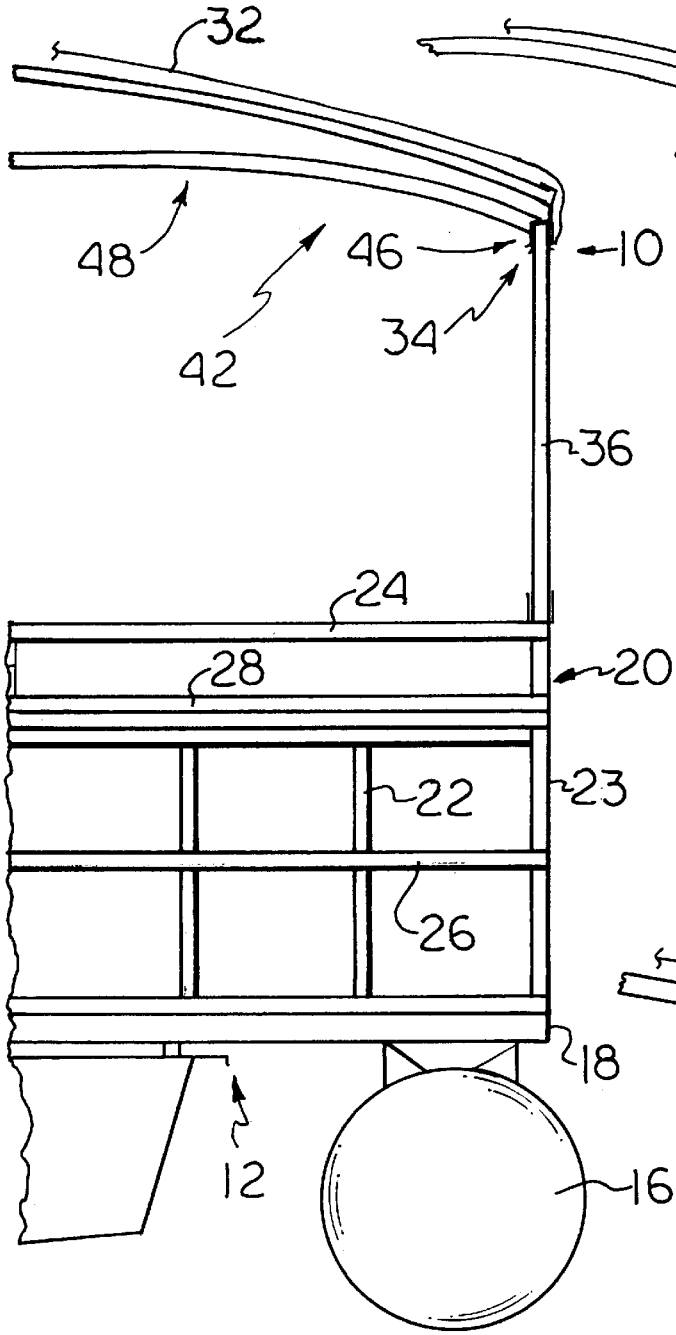
FIG. 4 is a slightly enlarged fragmentary rear view of the right one-half of the knock-down canopy, taken along the line 4—4 of FIG. 1, including a canopy cover supported one canopy framework.
Figure 5:
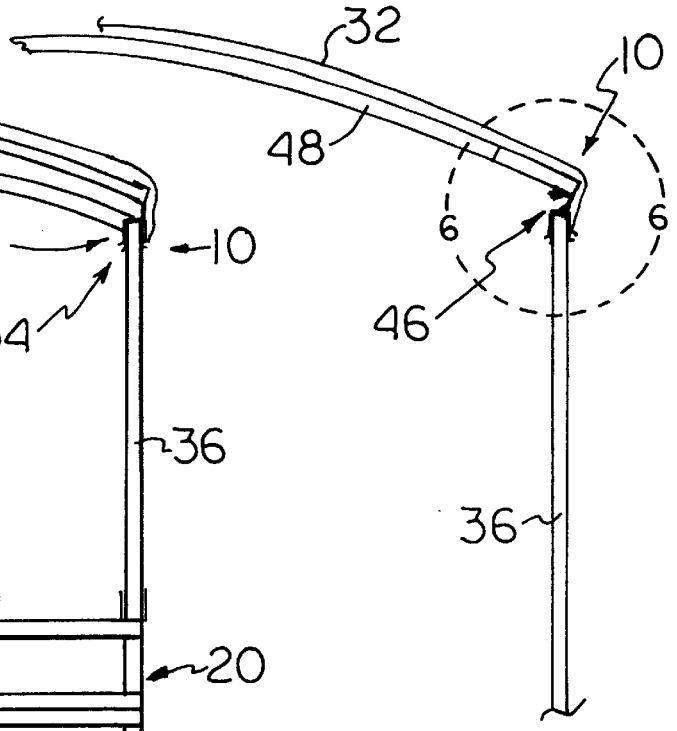
FIG. 5 is a fragmentary rear end view of a portion of the canopy illustrated in FIG. 4, more particularly illustrating one of the vertical support posts and one of the cross rails coupled together with a coupling member constructed according to the present invention.
Figure 6:
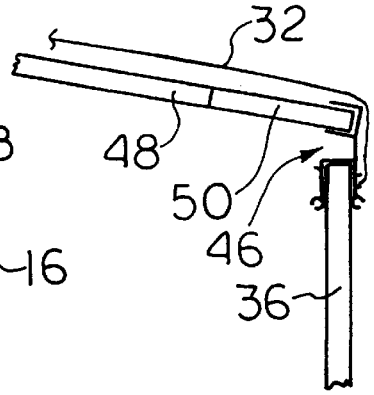
FIG. 6 is a slightly enlarged view of the portion encircled in the chain line circle 6—6 of FIG. 5.
Figure 6A:
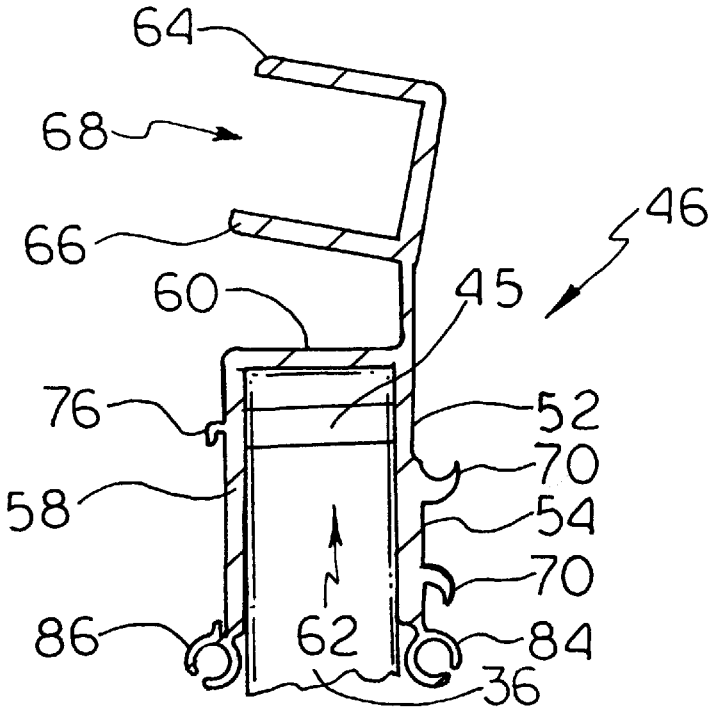
FIG. 6A is a greatly enlarged sectional end view, taken along the section line 6A—6A of FIG. 3A, illustrating an end rail coupled to an upstanding comer post the canopy top frame work illustrated in FIGS. 1–6.

As illustrated in FIGS. 4 and 8, the cross bows 48 are curved upwardly at their center portion so as to provide an eyebrow shaped cross rail thereby allowing water which would otherwise accumulate on the top side of the canvas cover 32 to drain laterally outwardly. The cross bows 48 are hollow and each includes a square, laterally outwardly downwardly inclined passage 135 which frictionally detachably slidably receives one laterally inner leg of a coupling member 50.

Front and rear laterally U-shaped end cross bows 136 and 138 are mounted at opposite ends of the downwardly opening slots 62 in the side frame rails 46.

The front and rear eyebrow cross bows each include an eyebrow shaped, crowned mid-section 140 and a pair of laterally outer longitudinally extending legs 142 which are received in the ends of side rail slots 62 and are fastened thereto with suitable bolts and nuts (not shown) for coupling the legs 142 to the lower, inner and outer wall portions 58 and 54, respectively.

The Operation and Method of Assembly

The vertical frame posts 36, side rails 46, cross rails 48 and L-shaped coupling members 50, leaf springs 128 along with assorted coupling bolts, are separately manufactured, packaged and shipped in a disassembled condition to a dealer or end user, for subsequent assembly on a boat 12. The side rails 46 and cross rails 48 are cut on-site to the desired lengths to accommodate the length and width, respectively, of the boat being covered.

The L-shaped coupling members 50 are initially assembled by disposing the lower leaf 126 of the leaf spring 128 inside the channel of the lower laterally inwardly extending lower leg portion 102 (FIG. 11) with the coupling pin 124 received in the locking opening 122. The upper L-shaped half 96 is then moved downwardly and laterally inwardly relative to the L-shaped half 96 so that the laterally inner side of the laterally inner wall 109 of the upper half 108 of leg 100 moves along the dotted line 115 (FIG. 12) and engages the laterally outer terminal spring leaf end 133. The upper L-shaped half 102 is then moved downwardly so that the locating pins 112 are received in the complementally formed located recesses 114 in the other leg.

At or near the boat site, the upstanding corner posts 36 are either coupled to the top fence rails 24 or directly mounted to the deck 18. The side rails 46 are mounted on the vertical posts 36 with the upper vertical post ends 44 received in the downwardly opening slots 62. Holes are drilled in the inner and outer lower sidewall portions 58 and 54, respectively, for receiving a coupling pin 41 coupled to the upper end of a mounting post 44.

Suitable locking holes 122 are also drilled in the undersides of opposite ends 69 of the cross rails 48. Aligned apertures are cut into the upper and lower side rail flanges 64 and 66 at any selected locations for receiving the pair of bolts 130.

A laterally inner leg 93 of an assembled L-shaped bracket 50 is then telescopically received in the passage 136 in the one outer end 69 of each of the cross rails 48. Before the bracket leg 93 is inserted therein, the user depresses the button or locating pin 124 vertically inwardly so that the terminal end thereof will clear the lower wall of the cross rail 48. The user will then push the leg 93 inwardly until the locating openings 122 and 126 are in alignment and then the leaf spring 128 will yieldably force the locking pin 124 outwardly to the position illustrated in FIG. 7 to detachably lock the transverse coupling bracket leg 93 to the outer end 69 of the cross rail 48.

The user will then slidably insert the laterally outer leg 95 into the laterally upwardly inwardly inclined slot 98 on one lateral side rail 46. The user will then slightly outwardly spring the opposite side rail 54 until the laterally outer coupling member legs 95 vertically clear the flanges 64 and 66 on the opposite side rail 46. The user will then slide the laterally outer legs 95 on the opposite ends of each cross rail slide 48 into the slots 68 on the opposite side rail 46. The cross rails 48 are disposed in longitudinally spaced apart relation as illustrated in FIGS. 1–3A. The cross-section of the laterally outer bracket leg 95, in the assembled position illustrated in FIG. 7, is such as to be snugly received in wiping engagement with the inside surfaces of the flanges 64 and 66.

A pair of bolts 130 is then inserted into the coupling member openings 121 and aligned opening in the flanges 64 and 66 to detachably lock the outer coupling bracket leg 93 to the flanges 64 and 66 and eliminate any swinging or rocking movement therebetween.

Alternatively, the laterally outer legs 95 can first be bolted to the side rail flanges 64 and 66 and the cross rails 48 thereafter mounted on the laterally inner bracket legs 93.

The canopy cover 32 is then draped over the assembled framework 42 and the perimeter mounting clips 72 on the cover sides 33 are slid or snapped onto the ribs 70.

In the event any of the cross rails 48 are inadvertently damaged, the framework 42 can be easily disassembled by removing the snaps 72 from the side rails 46 and removing the cover C. The L-shaped brackets can be easily detached from the rails 72 by merely pushing the buttons 124 inwardly and then laterally outwardly springing the side rails relative to each other. The side rails 46 and upstanding posts 22 are sufficiently yieldable to allow the side rails 46 to laterally outwardly yield relative to each other during assembly.

If desired, additional curtains or hangings may be hung on the inside of the boat with the hook and loop fasteners 82.

Likewisely, additional curtains or support members may be coupled to the welt channels 84 and 86.

Figure 3:
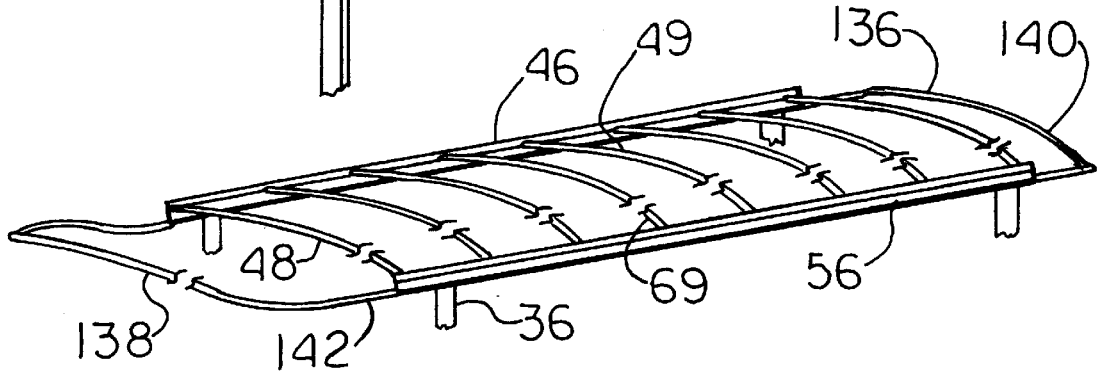
FIG. 3 is a perspective view thereof, similar to FIG. 2, illustrating a subsequent stage of assembly with the end bows assembled on the ends of the side rails.
Figure 3A:
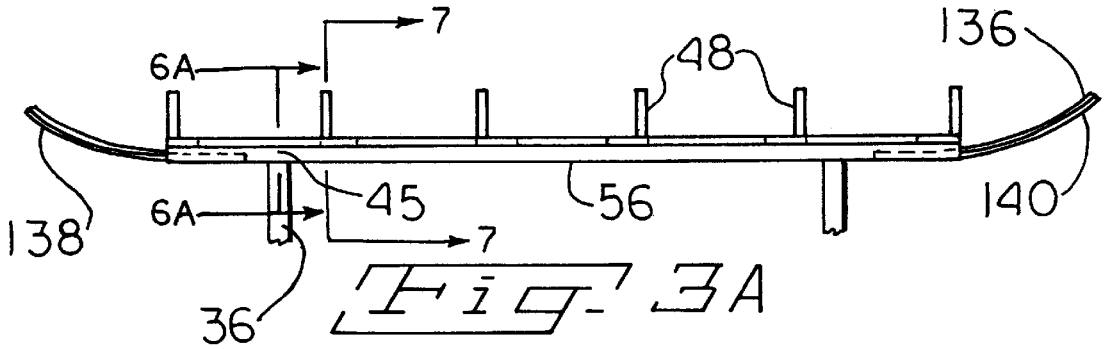
FIG. 3A is a side elevational view of the framework only.

The front and rear end bows 136 and 138 are then assembled into the ends of the side rails 46 as illustrated in FIGS. 1, 3 and 3A. This modular construction can be easily broken down and reassembled.

Modified Embodiment

Figure 14:
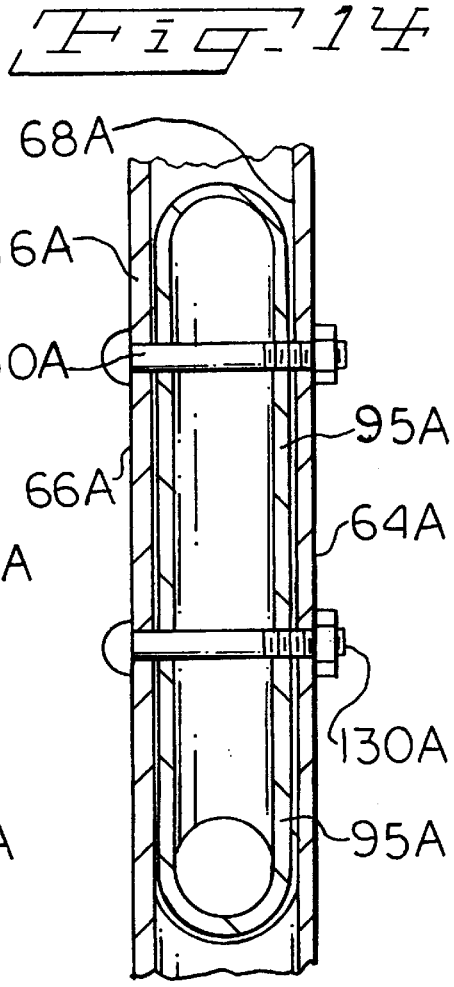
FIG. 14 is a greatly enlarged rear sectional side view, taken along the section line 14—14 of FIG. 13.
Figure 13:
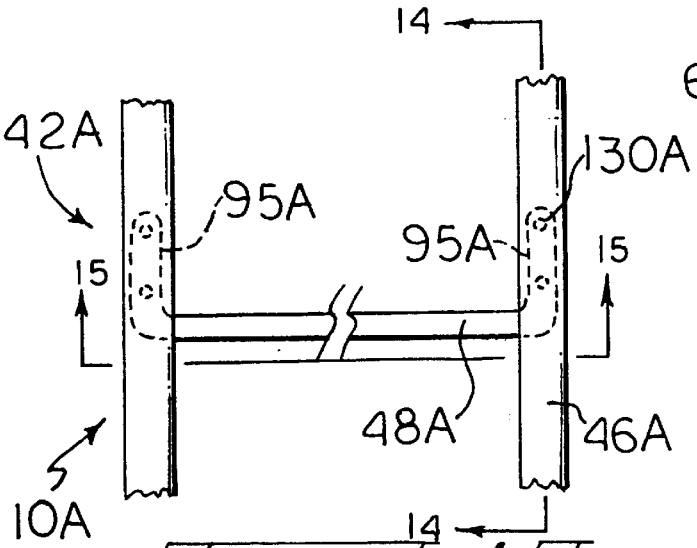
FIG. 13 is a greatly reduced top plan view of a slightly modified embodiment having a slightly modified cross rail.
Figure 15:
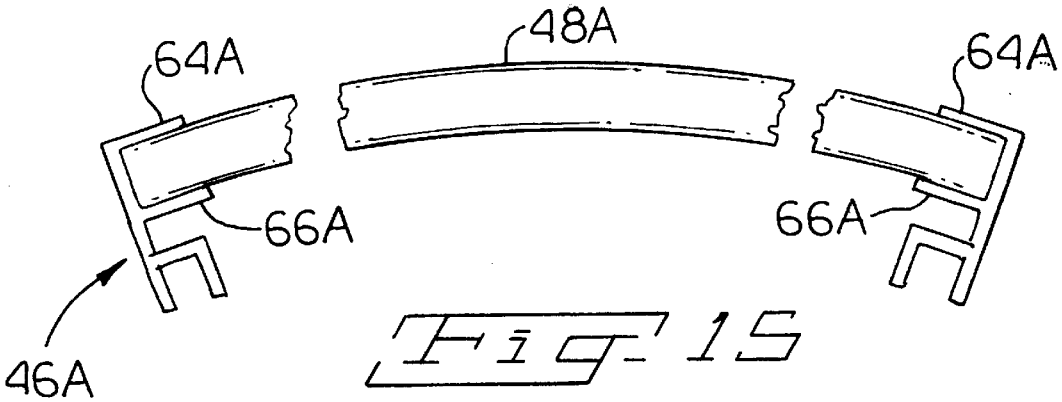
FIG. 15 is a greatly enlarged rear sectional view, taken along the line 15—15 of FIG. 13.

Referring now more particularly to FIGS. 13–15 a slightly modified canopy top shelter, generally designated 10A, is provided and is similar in many respects to the shelter 10 and generally similar parts are referred to by generally similar reference characters followed by the letter A subscript.

The roof framework 42A differs from the roof framework 42 in that the cross rails 48A are generally U-shaped in plan view as illustrated in FIG. 13. Rather than utilizing the L-shaped coupling brackets 50, the cross rails 48A include integral, laterally outer, longitudinally extending legs 95A which have a cross section that is formed complementally to the cross section of side rail slot 68A.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. A knock-down canopy top framework for detachably mounting a fabric cover over a deck on a boat, said framework including:

a pair of laterally spaced apart longitudinally extending, elongate side rails having confronting U-shaped, longitudinally extending receptacles defining laterally inwardly opening, elongate side slots;

a plurality of longitudinally spaced apart, laterally extending cross rails including opposite ends, extending between said side rails; and a plurality of coupling brackets for detachably coupling said opposite ends of said cross rails to said side rails;

each of said brackets including a laterally outer portion slidably detachably received by one of said U-shaped receptacles and a laterally inner portion for telescopingly detachably receiving one of said ends of one of said cross rails.

2. The knock-down canopy top framework set forth in claim 1 wherein said laterally inner portion and said one end including cooperating detent and receptacle mens for detachably mating with each other to detachably couple said laterally inner portion and said one end.

3. The knock-down canopy top framework set forth in claim 2 including two longitudinally spaced apart pins for detachably coupling said laterally outer portion to one of said U-shaped receptacles.

4. The knock-down canopy top framework set forth in claim 1 wherein each of said coupling brackets comprises an L-shaped bracket having upper and lower L-shaped mating bracket halves detachably coupled together to form a transversely extending laterally inwardly disposed leg and a longitudinally extending, laterally outer leg.

5. The knock-down canopy top framework set forth in claim 4 wherein one of said L-shaped mating bracket halves includes a locating pin projecting therefrom and the other of said L-shaped mating bracket halves includes a complementally formed locating recess for detachably receiving said locating pin.

6. The knock-down canopy top framework set forth in claim 5 wherein said laterally inwardly disposed legs of said bracket halves include confronting internal recesses defining a transverse opening; one of said bracket halves includes a locking opening therethrough; and a locking pin being slidably received in said locking opening; and spring means disposed in said transverse between said mating bracket halves mounting said locking pin for reciprocal movement in said locking opening.

7. The knock-down canopy top framework set forth in claim 1 wherein said laterally inner portions of said coupling brackets and said ends of said cross rails including first and second openings, respectively, therein which are aligned when said brackets are coupled to said cross rails; said laterally inner portions each including an internal transversely extending passage therein communicating with said first opening in said laterally inner portion; a lock pin slidably moveable in said first opening for movement between a locking position received in said second opening in said one end of said cross rail when said brackets are coupled together and a recessed non-locking position; and spring means disposed in said internal passage and yieldably mounting said pin for movement from said locking position to said recessed non-locking position.

8. The knock-down canopy top framework set forth in claim 1 including means for detachably coupling a flaccid cover in overlying relationship with said framework.

9. The knock-down canopy top framework set forth in claim 8 wherein each of said U-shaped receptacles comprises an upper outboard wall;

upper and lower vertically spaced apart laterally inwardly projecting legs integrally mounted on said outboard wall;

said elongate side rails each including a downwardly opening slotted receptacle comprising an upstanding lower outboard wall integral with said upper outboard wall but laterally inwardly offset relative thereto; and a laterally inner wall cooperating with said lower outboard wall to define a downwardly opening, elongate slot for detachably receiving a plurality of upstanding mounting posts in any selected one of a plurality of longitudinally spaced apart positions therein.

10. A one-piece elongate side rail for a knock-down canopy shelter, said side rail comprising:

an upstanding lower, laterally outer outboard wall and a laterally inner inboard wall defining a downwardly opening elongate slot for detachably receiving the upper ends of any selected ones of a plurality of upstanding mounting posts in any selected one of a plurality of longitudinal spaced apart positions;

an upper laterally outwardly offset outboard wall integral with, but laterally outwardly offset relative to, said lower outboard wall;

said upper outboard wall integrally mounting upper and lower flanges defining an inwardly opening elongate slot for mounting any selected ones of a plurality of cross rails.

11. The elongate side rail set forth in claim 10 wherein said lower outboard wall includes skirt mounting means for detachably dependently mounting a laterally outer flaccid skirt.

12. The elongate side rail set forth in claim 11 wherein said inboard wall includes curtain mounting means for detachably dependently mounting a laterally inner curtain.

13. The elongate side rail set forth in claim 12 wherein said skirt mounting means includes upper and lower vertically spaced, oppositely turned projecting legs for slidably receiving a canvas mounting clip for detachably mounting a canvas top thereon.

14. The elongate side rail set forth in claim 10 including means for detachably mounting a flaccid canopy cover thereon.

15. The one-piece elongate side rail set forth in claim 14 including first and second elongate welt channels mounted on the lower terminal ends of said inbound wall and said lower outboard wall for detachably receiving welt cords provided on sheets to be mounted thereon.

16. A canopy kit which can be assembled to form a canopy top frame for detachably mounting a flaccid cover over the deck of a recreation craft, such as a pontoon boat, said kit comprising:

a pair of side rails each including an outboard wall integrally mounting upper and lower, vertically spaced walls defining an inwardly opening elongate channel;

a plurality of cross rails having opposite ends;

means for detachably coupling said opposite ends of said cross rails to said side rails in any selected one of a plurality of different longitudinally spaced apart positions including a plurality of coupling brackets each including a laterally outer elongate portion for being detachably received in said channel and a transversely disposed laterally inner portion for telescopically receiving one of said ends of one of said cross rails.

17. The canopy kit set forth in claim 16 wherein coupling said brackets comprise L-shaped brackets each including a laterally inner transversely disposed leg and a laterally outer longitudinally disposed leg, said L-shaped bracket including upper and lower L-shaped mating bracket halves, one of said halves including at least one locating pin projecting therefrom, the other of said halves including a complementally formed locating recess for detachably receiving said locating pins.

18. The kit set forth in claim 17 wherein said coupling brackets each includes upper and lower confronting and complementally formed L-shaped bracket halves;

said upper L-shaped bracket half having an upper transversely disposed laterally inner leg, an upper longitudinally extending laterally outer leg said lower L-shaped bracket half having a lower transversely disposed laterally inner leg confronting said upper transversely disposed laterally inner leg and defining a laterally extending passage therebetween, and a lower, longitudinally extending, laterally outer leg confronting said upper longitudinally extending laterally outer leg, one of said upper and lower laterally inner legs including a locking opening therethrough communicating with said passage; spring means received in said passage and including a lock button slidably received in said opening for movement between a recessed position flush with said one half and a locking position projecting outwardly beyond said one half.

19. The canopy kit set forth in claim 16 including means for detachably coupling a flaccid cover to said canopy top frame.

20. The canopy kit set forth in claim 16 including means for detachably coupling a flaccid cover to said side rails.

21. The canopy kit set forth in claim 20 wherein said means for detachably coupling a flaccid cover comprises means mounted on said outboard wall.

22. The canopy kit set forth in claim 21 wherein said means mounted on said outboard wall comprises a pair of elongate, oppositely turned lips projecting laterally outwardly of said outboard wall for slidably receiving a cover mounting slide.

23. The canopy kit set forth in claim 16 wherein said outboard wall of each of said rails includes a lower generally vertical section and a laterally outwardly offset upper section; and said upper and lower vertically spaced apart walls are integrally coupled to said upper outwardly offset upper section.

24. The canopy kit set forth in claim 23 wherein said side rails each includes a lower second vertical section laterally inwardly relative said first mentioned lower vertical wall section to define a downwardly opening slot for receiving an upstanding mounting post.

25. The canopy kit set forth in claim 24 wherein each of said cross rails are bowed to include an upper central portion disposed between and above said opposite ends of said cross rails.

26. The canopy kit set forth in claim 25 including a pair of end bows each including a pair of L-shaped ends for being detachably mounted on opposite ends of said side rails.

27. A knock-down canopy shelter for an area to be covered, such as the deck of a pontoon boat, said canopy shelter comprising:

a plurality of posts, having first and seconds ends, adapted to be generally vertically mounted in longitudinally spaced apart relation on laterally opposite sides of an area to be covered;

a plurality of cross rails, having opposite ends, adapted to be generally horizontally transversely disposed in longitudinally spaced relation over the area to be covered, for detachably supporting a flaccid sheet of fabric;

means for detachably coupling said first ends of said posts to said opposite ends of said cross rails including a pair of elongate side rails adapted to be mounted on laterally opposite sides of the area to be covered, each of said side rails having a first elongate slot therein for receiving said first ends of said posts on one lateral side of said area to be covered, and a second elongate slot, transverse to said first elongate slot;

means for detachably coupling said pair of elongate side rails in laterally spaced apart relation to said opposite ends of said cross rails including a plurality of L-shaped coupling members each having one leg adapted to be detachably received in said second elongate slot in one of said side rails, and a second leg disposed transverse to said first leg for telescopically detachably receiving one of said opposite ends of one of said cross rails.

28. The canopy shelter set forth in claim 27 wherein said elongate side rails each include a laterally outer sidewall having a lower sidewall portion defining one lateral side of said first elongate slot and an upper sidewall portion defining an end wall of said second elongate slot;

said upper sidewall section being laterally outwardly offset relative to said lower sidewall portion.

29. The canopy shelter set forth in claim 27 wherein said elongate rails each include a laterally outer elongate sidewall having a lower elongate sidewall portion for coupling to said first ends of said posts, and an upper elongate integral sidewall portion, laterally outwardly offset relative to said lower elongate sidewall portion, for detachably coupling to one of said opposite ends of each of said L-shaped coupling member.

30. The canopy shelter set forth in claim 29 wherein each of said side rails include a pair of vertically spaced apart flanges integral with said upper elongate sidewall portion defining said second elongate slot.

31. The canopy shelter set forth in claim 29 including means for detachably coupling the flaccid sheet of fabric to said elongate side rails.

32. A knock-down canopy shelter for an area to be covered, such as a pontoon deck area, said canopy shelter comprising:

an elongate side rail for detachably coupling an upper end of each of a plurality of longitudinally spaced apart, upstanding canopy support posts to a plurality of generally horizontally disposed longitudinally spaced apart cross rails, said side rail including laterally inner and outer lower sidewall portions defining a downwardly opening slot for receiving the upper end of at least one of the upstanding canopy support posts;

a laterally outer upper sidewall portion extending upwardly and laterally outwardly of said lower sidewall portion; and vertically spaced apart upper and lower vertically upwardly inwardly inclined walls, mounted on said upper sidewall portion defining a laterally inwardly opening slot for detachably receiving an end portion each of the plurality of longitudinally spaced apart cross rails.

33. The knock-down canopy shelter set forth in claim 32 including means for detachably coupling a sheet of flaccid fabric to said elongate side rail.

34. A knock-down canopy shelter for a boat such as a pontoon boat, comprising:

a plurality of generally upstanding posts adapted to be mounted longitudinally spaced apart relation on laterally opposite sides of said boat said posts each having a lower end adapted to be coupled to said boat and an upper end;

a plurality of longitudinally spaced apart laterally extending cross rails having opposite ends;

a plurality of elongate one-piece side rails each including a laterally outer wall having a generally upstanding lower wall portion and a laterally outwardly upwardly inclined upper wall portion, a laterally inner wall cooperating with said upstanding lower wall portion to define a downwardly opening slot for detachably receiving said upper ends of said upstanding posts, and a pair of upper and lower laterally inwardly projecting elongate walls cantileverly mounted on said upper wall portion to define a vertically upwardly inwardly opening elongate slot;

bracket means for detachably coupling said opposite ends of said cross rails to said side rails including a plurality of coupling members each including an elongate laterally outer portion detachably received in said vertically upwardly inwardly opening elongate slot, and a transverse laterally inner portion telescopically receiving one of said opposite ends of one of said cross rails; and means for detachably coupling a flaccid sheet of fabric to said side rails.

35. The knock-down canopy shelter set forth in claim 34 wherein said coupling members each comprises upper and lower L-shaped members disposed in confronting relation, said laterally inner portion of said lower L-shaped members having a U-shaped cross section defining a first transverse defining a channel therein, said laterally inner portion of said upper L-shaped member having an inverted U-shaped cross section defining a channel therein defining a second channel opposing said first transverse channel.

36. The knock-down canopy set forth in claim 35 including a first aperture in each of said opposite ends of said cross rails, each of said lower L-shaped members having a second aperture disposed in alignment with said first aperture when said brackets are assembled on said cross rails; and spring means is disposed between said L-shaped members including a locking pin received by said first and second aligned apertures but yieldable to allow said locking pin to move upwardly to a position removed from said first aperture so that said coupling members may be detached from said opposite ends.

37. The knock-down canopy shelter set forth in claim 36 including a welt cord channel at the lower end of said lower wall portion for detachably receiving a welt bead on a canvas skirt.

38. A knock-down canopy shelter for a boat such as a pontoon boat, comprising:

a knock-down framework for supporting a sheet of flaccid fabric canopy cover including a plurality of spaced apart posts adapted to be vertically mounted in longitudinally spaced relation on laterally opposite sides of said boat;

a plurality of longitudinally spaced apart laterally extending frame means, adapted to overlie said boat, including laterally opposite, longitudinally extending terminal ends;

a pair of one-piece elongate side rails each having a lower end for detachably mounting on said posts and an upper end which is laterally outwardly offset relative to said lower end;

a pair of vertically spaced apart laterally inwardly projecting flanges on said upper end defining an elongate, upwardly inwardly inclined slot for detachably receiving said longitudinally extending terminal ends.

39. The knock-down canopy shelter set forth in claim 38 including a sheet of fabric canopy cover for overlying said frame means; and means for detachably coupling said sheet of flaccid fabric canopy cover to said frame means.

40. The knock-down canopy shelter set forth in claim 39 including means for detachably coupling said longitudinally extending terminal ends to said side rails.

41. The knock-down canopy shelter set forth in claim 39 wherein said side rails include a pair of longitudinally spaced apart openings in one of said flanges; said longitudinally extending terminal ends including a pair of openings therein disposed in alignment with said pair of spaced apart openings in said one flange; and a pair of locking pin means mounted on said longitudinally extending terminal ends for sliding movement between locking positions received by said aligned pair of openings and retracted positions removed from said openings in said one flange.

42. The knock-down canopy shelter set forth in claim 41 including spring means yieldably mounting said locking pin means on said longitudinally extending terminal ends.

43. A method of assembling a canopy shelter on a boat, such as a pontoon boat, comprising the step of:

mounting a plurality of longitudinally spaced, upstanding posts on laterally opposite sides of a deck;

assembling a canopy top on said posts comprising the steps of mounting a pair of elongate side rails, each having a laterally inwardly extending elongate slot therein, on the upper ends of said posts;

detachably coupling a plurality of longitudinally spaced apart, transversely extending cross rails to said side rails by;

mounting a laterally inner transverse portion of one of a plurality of coupling members on each end of each of a plurality of longitudinally spaced apart, laterally extending cross rails, and sliding a second laterally outer elongate portion of said one of said coupling members into said laterally inwardly extending elongate slot.

44. The method set forth in claim 43 wherein said step of detaching coupling is accomplished by telescopically mounting said transverse portion of said one of said plurality of coupling members on each end of each of said plurality of cross rails.

45. The method set forth in claim 43 wherein said step of detachably coupling is accomplished by telescopically mounting one transversely disposed laterally inner leg of an L-shaped coupling member on each end of each of said plurality of cross rails and said sliding step is accomplished by sliding a second elongate laterally outer leg of said L-shaped coupling member into said inwardly extending elongate slot.

46. The method set forth in claim 45 wherein said step of detachably coupling is further accomplished by mounting a spring mounted lock pin on said transversely disposed leg for movement within an opening provided in said transversely disposed leg between an unlocking, recessed position within said one transversely disposed leg and a locking position projecting outwardly beyond said transversely disposed leg; and aligning said lock pin with a second opening provided in said one end of said one cross rail.

47. The method set forth in claim 45 including the step of cutting said cross rails to a selected length and then drilling locking holes in the remaining terminal ends of said cross rails for detachably receiving said lock pin in said locking position prior to said assembling step; cutting said side rails to a selected length and then drilling longitudinally spaced apart pairs of longitudinally spaced apart vertical holes in a pair of laterally inwardly extending flanges which define said inwardly extending slot for alignment with holes provided in said laterally outer leg prior to said assembling step and then placing pairs of pins in said pairs of holes in said flanges and said holes in said laterally outer legs; and drilling horizontal holes in any selected portion of a pair of laterally spaced apart flanges provided on a lower portion of said side rails prior to said step of mounting said side rails on said posts and then placing coupling pins in said horizontal holes and aligned holes in the upper ends of said posts.

48. The method set forth in claim 43 including the step of assembling said coupling members prior to said step of mounting said transverse portion; said step of assembling each of said coupling members being accomplished by the steps of selecting a leaf spring having upper and lower confronting leafs coupled to an intermediate leaf spring portion;

coupling a push button to said lower leaf;

sandwiching said leaf spring between upper and lower coupling member halves and aligning said push button with a first opening provided in said transverse portion of said lower coupling member halves for movement therein between a retracted position generally flush with the underside of said transverse portion of said lower coupling member halves and a locking position projecting outwardly beyond said underside of said transverse portion; and aligning said opening in a second opening provided in said end of said cross rail to allow said push button to spring outwardly into said second opening.

49. The method set forth in claim 45 wherein said sandwiching step is accomplished by placing said lower leaf in a transversely extending groove in said transverse portion of said lower coupling member halves with said intermediate portion disposed laterally inwardly of said push button and disposing said push button in said first opening;

moving said upper coupling member halves downwardly and laterally inwardly relative to said lower coupling member halves to dispose a terminal end of said upper leaf into a transverse disposed groove provided in the underside of said transverse portion of said upper coupling member halves.

50. The method set forth in claim 46 including the step of providing a male locating pin on one of said coupling member halves and a complementally formed female locating recess in the other of said coupling member halves; and said step of moving said upper coupling member half includes the step of moving said pin and said recess from positions not in vertical alignment to positions in vertical alignment and then pushing said coupling halves together to dispose said locating pin in said locating recess.

51. The method set forth in claim 47 wherein said step of mounting a transverse portion is accomplished by mounting one transversely disposed leg of a L-shaped coupling member on each end of said cross rails and said sliding step is accomplished by sliding a longitudinally disposed leg of said L-shaped coupling member into said elongate slot.

52. In combination with a fabric covering, for covering an area to be protected, such as a pontoon boat deck, a knock-down canopy framework which can be assembled to support said covering and disassembled for storage and shipping; said framework comprising:

a pair of elongate side rails adapted to be disposed on laterally opposite sides of an area to be protected, said pair of side rails including a lower upstanding elongate portion for mounting on support posts; and an upper elongate roof support portion including laterally inwardly, upwardly inclined elongate slots;

a plurality of longitudinally spaced apart laterally extending cross rails;

means for detachably coupling opposite ends of said cross rails to said side rails including a plurality of coupling members including laterally inner transverse portions detachably coupled to opposite ends of said cross rails and laterally outer elongate portions detachably received in said slots;

means for detachably coupling said fabric covering to said framework.

53. The combination set forth in claim 49 wherein said upper portion is laterally outwardly offset relative to said lower portion.

54. The combination set forth in claim 49 wherein said lower portion includes laterally inner and outer upstanding lower walls defining a downwardly opening elongate slot for receiving a plurality of upstanding mounting posts; said upper portion includes a laterally outer wall which is integral with, but laterally upwardly outwardly inclined to said laterally outer lower wall;

said upper portion including upper and lower flanges projecting laterally inwardly upwardly from said laterally outer upper wall to define said elongate slot.

* * * * *